US008884542B2

(12) United States Patent
Zhang et al.

(10) Patent No.: US 8,884,542 B2
(45) Date of Patent: Nov. 11, 2014

(54) SELF-OSCILLATING DIMMABLE ELECTRONIC BALLAST

(75) Inventors: Weiqiang Zhang, Shanghai (CN); Yan Zhong, Shanghai (CN); Jianping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 150 days.

(21) Appl. No.: 13/314,820

(22) Filed: Dec. 8, 2011

(65) Prior Publication Data

US 2013/0049629 A1 Feb. 28, 2013

(30) Foreign Application Priority Data

Aug. 23, 2011 (CN) ..... 2011 1 0243373

(51) Int. Cl.
*H05B 41/16* (2006.01)
*H05B 41/282* (2006.01)
*H05B 41/295* (2006.01)

(52) U.S. Cl.
CPC ..... *H05B 41/295* (2013.01); *H05B 41/2828* (2013.01)
USPC ..... 315/278; 315/224; 315/291

(58) Field of Classification Search
USPC ..... 315/278
See application file for complete search history.

(56) References Cited

U.S. PATENT DOCUMENTS

| | | | | |
|---|---|---|---|---|
| 6,407,514 | B1 * | 6/2002 | Glaser et al. | 315/247 |
| 6,424,101 | B1 * | 7/2002 | Sabate | 315/307 |
| 6,696,803 | B2 * | 2/2004 | Tao et al. | 315/291 |
| 6,815,908 | B2 * | 11/2004 | Glaser et al. | 315/224 |
| 7,529,107 | B2 * | 5/2009 | Mehta | 363/53 |
| 7,816,872 | B2 * | 10/2010 | Nerone et al. | 315/224 |
| 7,973,494 | B2 * | 7/2011 | Yao et al. | 315/291 |
| 8,742,670 | B2 * | 6/2014 | Zhong et al. | 315/115 |

* cited by examiner

*Primary Examiner* — Alexander H Taningco
*Assistant Examiner* — Nelson Correa
(74) *Attorney, Agent, or Firm* — Kirton McConkie; Evan R. Witt

(57) ABSTRACT

An electronic ballast for driving a light-emitting device, includes a square wave generator having a plurality of switch elements for converting a DC input voltage into a square-wave AC voltage. A transformer has a driving winding and a plurality of inductive windings mutually connected with each other, in which at least a portion of the inductive windings are respectively connected to a control terminal of the switch element. A resonant circuit connects the driving winding and a light-emitting device and converts the square-wave voltage into an AC output voltage to drive the light-emitting device. An auxiliary control unit connected to the transformer regulates a voltage waveform of the driving winding or a voltage waveform of the inductive winding according to a control signal, thereby changing the voltage waveform of the inductive winding connected to the switch element to adjust the switching frequencies of the switch elements.

15 Claims, 6 Drawing Sheets

SELF-OSCILLATING DIMMABLE ELECTRONIC BALLAST

FIELD OF THE INVENTION

The invention relates to an electronic ballast, and more particularly to a self-oscillating electronic capable of achieving dimming function, breaking down the light-emitting device to ignite, and preheating the filaments of the light-emitting device.

BACKGROUND OF THE INVENTION

In recent years, with the great advancement of power electronics, the electronic ballasts have replaced the conventional electromagnetic ballasts for driving fluorescent lamps. The electronic ballast is advantageous in terms of the thin and small size, enhanced illuminating efficiency, and improved luminance.

The electronic ballasts have various topologies in practice. The self-oscillating electronic ballast is widely employed as the self-oscillating electronic ballast has a short startup time, high illuminating efficiency, low cost, and simple structure. However, the self-oscillating electronic ballast is difficult to perform dimming control and preheat the filaments of the lamp due to its inherent design limitation. Thus, the lifetime of the lamp driven by the self-oscillating electronic ballast is negatively affected.

It is incline to develop an electronic ballast to address the aforementioned problems encountered by the prior art.

SUMMARY OF THE INVENTION

An object of the invention is to provide an electronic ballast configured in a self-oscillating topology for regulating the switching frequency of its internal switch elements by the windings of a transformer thereof, thereby preheating the filaments of the light-emitting device, breaking down the light-emitting device, and performing dimming control to the light-emitting device. Thus, the inventive electronic ballast can remove the deficiencies encountered by the conventional self-oscillating electronic ballast.

To this end, the invention provide an electronic ballast, which includes a square wave generator receiving a DC input voltage and having a plurality of switch elements for converting the DC input voltage into a square-wave AC voltage according to the switching operations of the switch elements; a transformer having a driving winding and a plurality of inductive windings mutually connected with each other, wherein at least a portion of the inductive windings are respectively connected to a control terminal of the switch element; a resonant circuit connected to the driving winding and the light-emitting device for receiving the square-wave voltage through the driving winding and converting the square-wave voltage into an AC output voltage to drive the light-emitting device; and an auxiliary control unit connected to the transformer for regulating the voltage waveform of the driving winding or the voltage waveform of the inductive winding according to a control signal, thereby changing the voltage waveform of the inductive winding connected to the switch element. Thus, the switching frequencies of the switch elements are adjusted.

Now the foregoing and other features and advantages of the invention will be best understood through the following descriptions with reference to the accompanying drawings, in which:

DESCRIPTION OF THE PREFERRED EMBODIMENT

An exemplary embodiment embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

Figure 1:
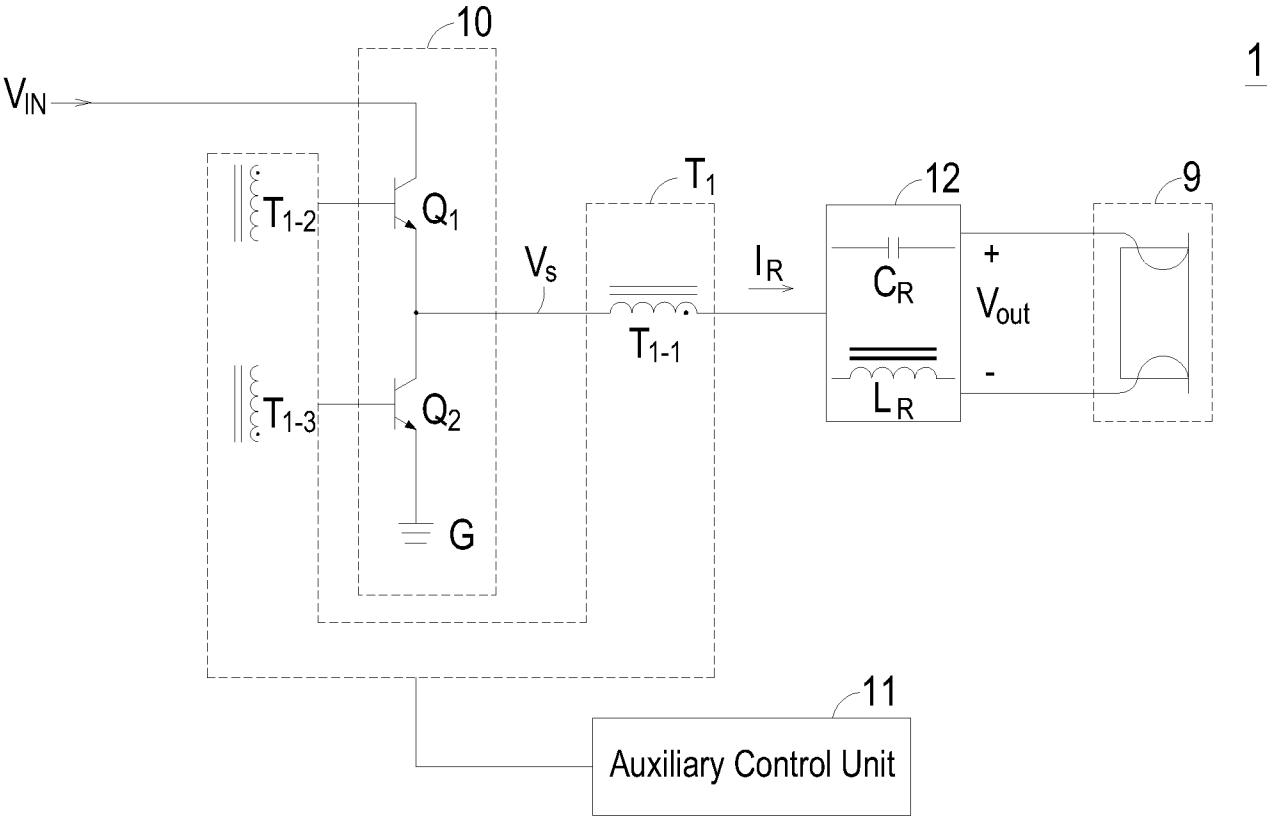
FIG. 1 is a circuit block diagram showing the electronic ballast according to an exemplary embodiment of the invention.

FIG. 1 is a circuit block diagram showing the electronic ballast according to an exemplary embodiment of the invention. As shown in FIG. 1, an electronic ballast 1 is used to receive a DC input voltage $V_{IN}$ and is connected to at least one light-emitting device 9, such as a fluorescent lamp or a light-emitting diode (LED). The electronic ballast 1 is used to convert the DC input voltage $V_{IN}$ into a sinusoidal AC output voltage $V_{out}$ for driving the light-emitting device 9. The electronic ballast 1 includes a square wave generator 10, a transformer $T_1$, an auxiliary control unit 11, and a resonant circuit 12. The square wave generator 10 is used to receive the DC input voltage $V_{IN}$ and includes a plurality of switch elements, such as a first switch element $Q_1$ and a second switch element $Q_2$ connected with each other in a half-bridge configuration. The square wave generator 10 is used to convert the DC input voltage $V_{IN}$ into a square-wave AC voltage $V_S$ according to the switching operations of the first switch element $Q_1$ and the second switch element $Q_2$. Certainly, the square wave generator 10 may include four switch elements connected with each other in a full-bridge configuration.

The transformer $T_1$ includes a driving winding $T_{1-1}$ and a plurality of inductive windings, such as a first inductive winding $T_{1-2}$ and a second inductive winding $T_{1-3}$ which are mutually coupled together. The driving winding $T_{1-1}$ is connected to the output end of the square wave generator 10 and is used to receive the square-wave AC voltage $V_S$ for generating a square-wave control signal (not indicated). The square-wave control signal is coupled to the first inductive winding $T_{1-2}$ and the second inductive winding $T_{1-3}$. The first inductive winding $T_{1-2}$ is connected to the control terminal of the first switch element $Q_1$. The second inductive winding $T_{1-3}$ is connected to the control terminal of the second switch element $Q_2$. The polarity of the first inductive winding $T_{1-2}$ is opposite to the second inductive winding $T_{1-3}$. The first inductive winding $T_{1-2}$ and the second inductive winding $T_{1-3}$ are used to control the first switch element $Q_1$ and the second switch element $Q_2$ by the square-wave control signal of the driving winding $T_{1-1}$, thereby driving the first switch element $Q_1$ and the second switch element $Q_2$ to turn on and off alternately.

The resonant circuit 12 is connected between the driving winding $T_{1-1}$ and the light-emitting device 9, and may be consisted of a resonant capacitor $C_R$ and a resonant inductor $L_R$, the resonant circuit 12 is used to receive the square-wave AC voltage $V_S$ through the driving winding $T_{1-1}$ and convert the square-wave AC voltage $V_S$ into an AC output voltage $V_{out}$ by resonance. Also, during the resonance stage, the resonant circuit 12 will generate a resonant current $I_R$ which flows through the driving winding $T_{1-1}$, so that the driving winding $T_{1-1}$ can generate the square-wave control signal for controlling the first switch element $Q_1$ and the second switch element $Q_2$ and coupling the square-wave control signal to the first inductive winding $T_{1-2}$ and the second inductive winding $T_{1-3}$. Therefore, the switching operations of the first switch element $Q_1$ and the second switch element $Q_2$ are controlled. Furthermore, as the polarity of the first inductive winding $T_{1-2}$ is opposite to the second inductive winding $T_{1-3}$, the first switch element $Q_1$ and the second switch element $Q_2$ are alternately turned on and off. Thus, the electronic ballast is termed a self-oscillating electronic ballast.

The auxiliary control unit 11 is connected to the driving winding $T_{1-1}$, the first inductive winding $T_{1-2}$, or the second inductive winding $T_{1-3}$ for regulating the voltage waveforms of the driving winding $T_{1-1}$, the first inductive winding $T_{1-2}$, or the second inductive winding $T_{1-3}$ according to a control signal (not indicated), so that the voltage waveforms of the driving winding $T_{1-1}$, the first inductive winding $T_{1-2}$, or the second inductive winding $T_{1-3}$ are commuted beforehand. As the driving winding $T_{1-1}$, the first inductive winding $T_{1-2}$, and the second inductive winding $T_{1-3}$ are mutually coupled, the voltage waveforms of the driving winding $T_{1-1}$, the first inductive winding $T_{1-2}$, and the second inductive winding $T_{1-3}$ will commute together in a direct way or in a indirect way by the electrical connection with the auxiliary control unit 11 or the their mutual coupling. Hence, by the control of the auxiliary control unit 11, the waveforms of the voltages on the first inductive winding $T_{1-2}$ and the second inductive winding $T_{1-3}$ that are used to respectively control the first switch element $Q_1$ and the second switch element $Q_2$ can commute beforehand. In other words, the periods of the voltage waveforms of the first inductive winding $T_{1-2}$ and the second inductive winding $T_{1-3}$ are shortened, thereby increasing the switching frequencies of the first switch element $Q_1$ and the second switch element $Q_2$. Therefore, the AC output voltage $V_{out}$ can be varied to achieve the dimming function, break down the light-emitting device 9, and preheat the filaments of the light-emitting device 9.

Figure 2:
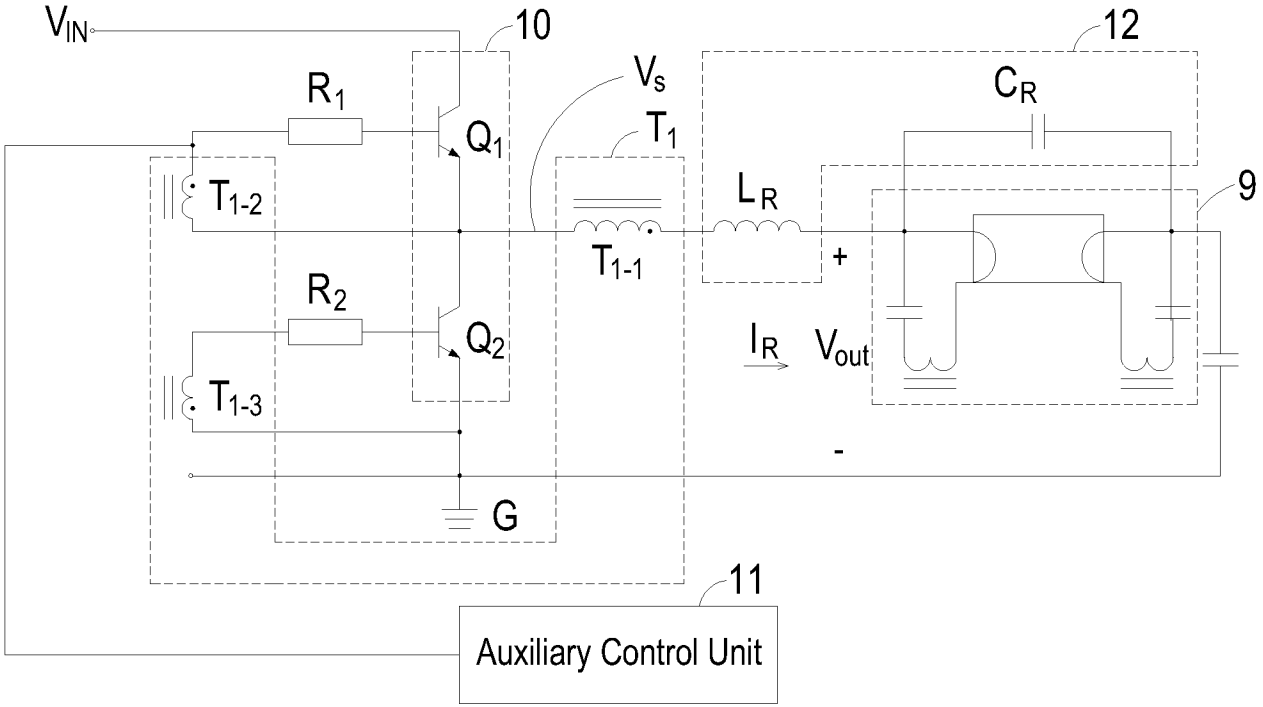
FIG. 2 shows the partial circuitry of the electronic ballast of FIG. 1.

Referring to FIG. 2 and FIG. 1, in which FIG. 2 shows the partial circuitry of the electronic ballast of FIG. 1. As shown in FIG. 2, the first switch element $Q_1$ and the second switch element $Q_2$ of the square wave generator 10 may be implemented by transistors. In that case, the collector of first switch element $Q_1$ is used to receive the DC input voltage $V_{IN}$, the emitter of the of first switch element $Q_1$ is connected to the collector of the second switch element $Q_2$, and the emitter of the second switch element $Q_2$ is connected to the ground terminal G.

In this embodiment, the resonant inductor $L_R$ is connected between one end of the driving winding $T_{1-1}$ and the light-emitting device 9. The resonant capacitor $C_R$ is connected in parallel with the light-emitting device 9 and connected to the resonant inductor $L_R$. Thus, the resonant inductor $L_R$ and the resonant capacitor $C_R$ form a parallel resonant circuit. In this embodiment, the resonant capacitor $C_R$ may be connected between the resonant inductor $L_R$ and the light-emitting device 9, thereby allowing the resonant inductor $L_R$ and the resonant capacitor $C_R$ to form a series resonant circuit.

In this embodiment, the transformer $T_1$ includes a driving winding $T_{1-1}$, a first inductive winding $T_{1-2}$, and a second inductive winding $T_{1-3}$. Moreover, the driving winding $T_{1-1}$, the first inductive winding $T_{1-2}$, and the second inductive winding $T_{1-3}$ are magnetically coupled with each other. The driving winding $T_{1-1}$ is connected to the output end of the square wave generator 10, and is connected to the emitter of the first switch element $Q_1$ and the collector of the second switch element $Q_2$ through the output end of the square wave generator 10. The first inductive winding $T_{1-2}$ is connected to the base of the first switch element $Q_1$ through a first resistor $R_1$, and is connected to the emitter of the first switch element $Q_1$. The second inductive winding $T_{1-3}$ is connected to the base of the second switch element $Q_2$ through a second resistor $R_2$, and is connected to the emitter of the second switch element $Q_2$.

In this embodiment, the auxiliary control unit 11 is connected to the first inductive winding $T_{1-2}$, and connected to the base of the first switch element $Q_1$ through a first resistor $R_1$. The auxiliary control unit 11 is configured to directly control the voltage waveform of the first inductive winding $T_{1-2}$ to commute beforehand according to the control signal received therefrom, thereby adjusting the switching frequency of the first switch element $Q_1$. Also, as the first inductive winding $T_{1-2}$ and the second inductive winding $T_{1-3}$ are mutually coupled, the voltage waveform of the second inductive winding $T_{1-3}$ is indirectly controlled to commute beforehand by the auxiliary control unit 11. Therefore, the switching frequency of the second switch element $Q_2$ is adjusted accordingly. Hence, the AC output voltage $V_{out}$ can be varied to achieve the dimming function, break down the light-emitting device 9, and preheat the filaments of the light-emitting device 9.

Figure 3:
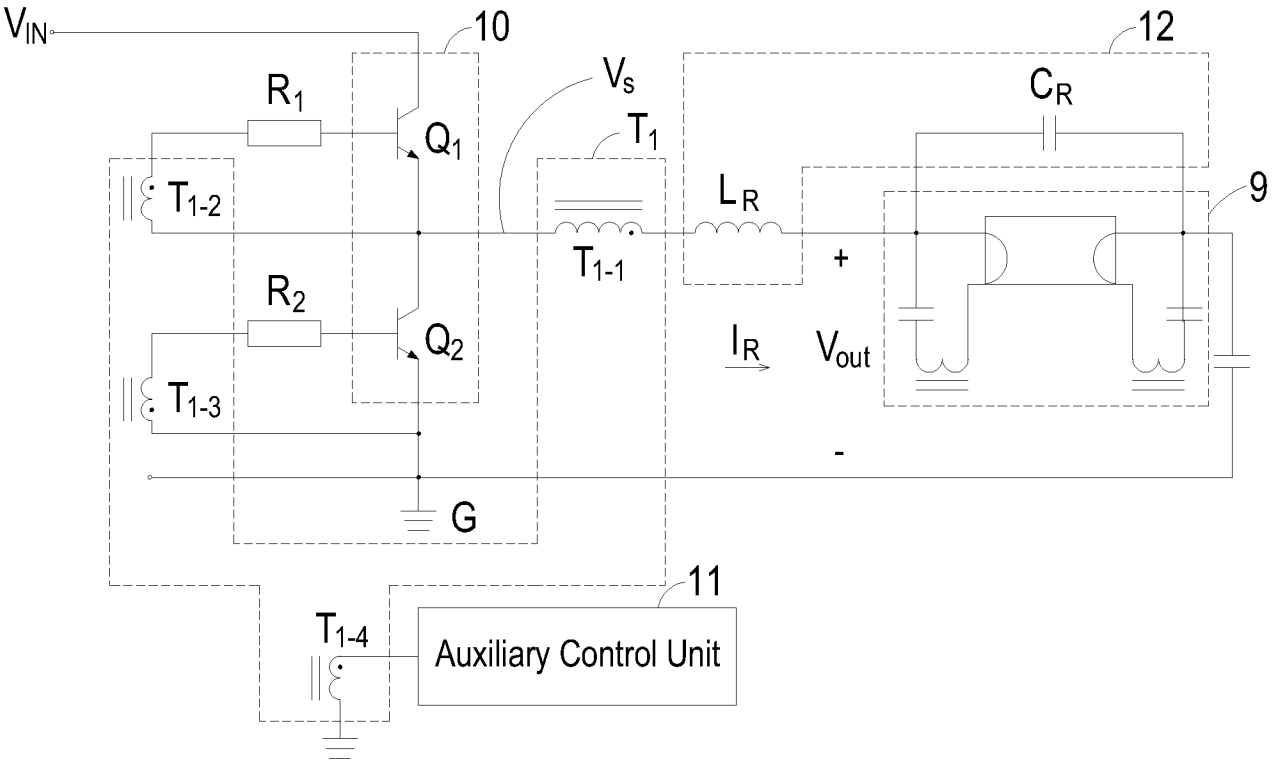
FIG. 3 shows an alternative example of the circuitry of the electronic ballast of FIG. 2.

In this embodiment, as shown in FIG. 3, the transformer $T_1$ may include a third inductive winding $T_{1-4}$ that is connected to the ground terminal G and magnetically coupled with the driving winding $T_{1-1}$, the first inductive winding $T_{1-2}$, and the second inductive winding $T_{1-3}$. Also, the auxiliary control unit 11 is connected to the third inductive winding $T_{1-4}$ instead. The auxiliary control unit 11 is configured to directly control the voltage waveform of the third inductive winding $T_{1-4}$ to commute beforehand according to the received control signal. As the third inductive winding $T_{1-4}$ is mutually coupled with the first inductive winding $T_{1-2}$ and the second inductive winding $T_{1-3}$, the voltage waveform of the first inductive winding $T_{1-2}$ and the voltage waveform of the second inductive winding $T_{1-3}$ will be indirectly controlled by the auxiliary control unit 11 to commute beforehand. In this manner, the switching frequency of the first switch element $Q_1$ and the switching frequency of the second switch element $Q_2$ can be adjusted by the auxiliary control unit 11, thereby allowing the AC output voltage $V_{out}$ to vary accordingly to preheat the filaments of the light-emitting device 9, break down the light-emitting device 9, and perform the dimming function to the light-emitting device 9.

Figure 4:
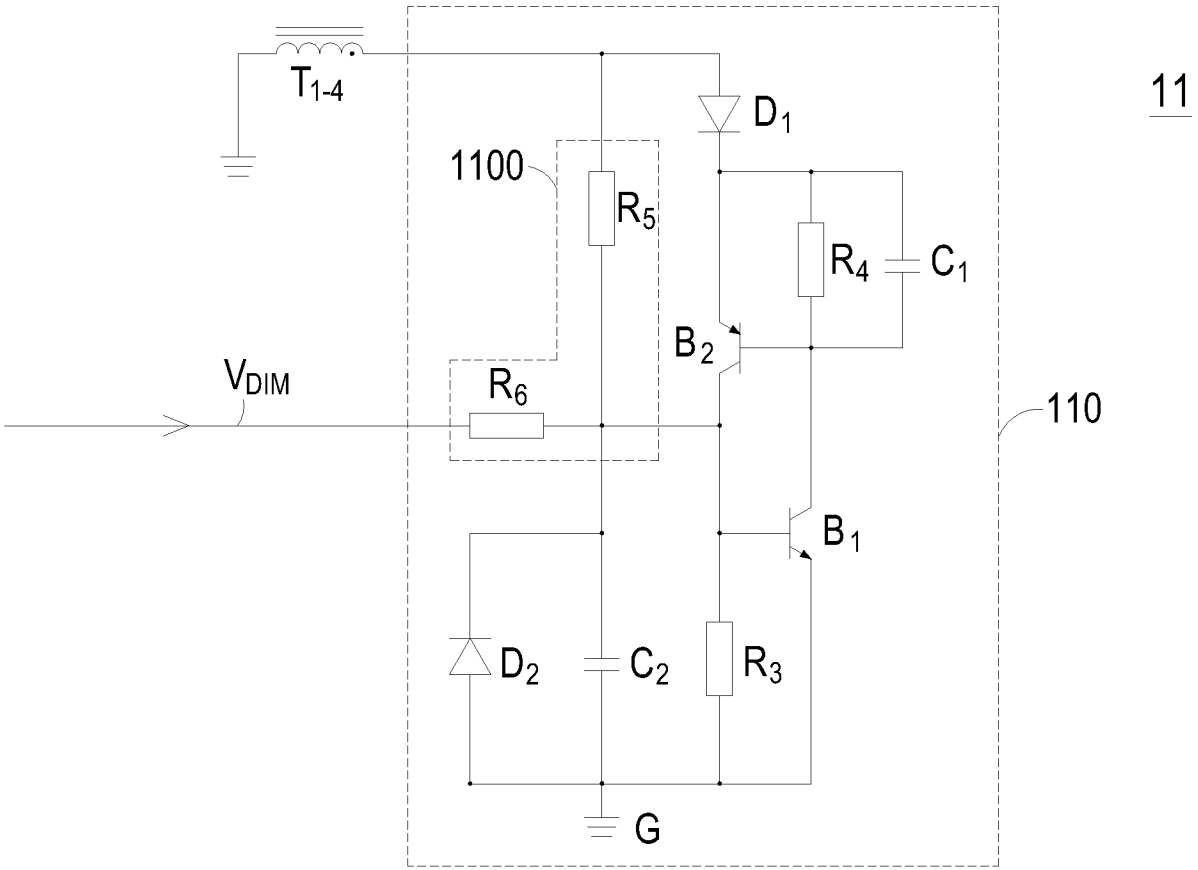
FIG. 4 shows the detailed circuitry of the auxiliary control unit shown in FIG. 3.

Next, the detailed circuitry of the auxiliary control unit 11 will be illustrated with reference to the configuration of FIG. 3. Referring to FIG. 4 and FIG. 3, in which FIG. 4 FIG. 4 shows the detailed circuitry of the auxiliary control unit shown in FIG. 3. In this embodiment, the auxiliary control unit 11 includes a clamping circuit 110 connected to the third inductive winding $T_{1-4}$. The input end of the clamping circuit 110 is used to receive a control signal $V_{DIM}$ that can be inputted from external circuits or generated by internal circuits. The clamping circuit 110 is used to control the voltage waveform of the windings connected to the auxiliary control unit 11 according to the magnitude of the control signal $V_{DIM}$. In this embodiment, the voltage waveform of the third inductive winding $T_{1-4}$ is controlled by the clamping circuit 110 according to the magnitude of the control signal $V_{DIM}$. Also, as the third inductive winding $T_{1-4}$ is mutually coupled with the first inductive winding $T_{1-2}$ and the second inductive winding $T_{1-3}$, the voltage waveform of the first inductive winding $T_{1-2}$ and the voltage waveform of the second inductive winding $T_{1-3}$ will also be indirectly controlled by the clamping circuit 11. In this manner, the switching frequency of the first switch element $Q_1$ and the switching frequency of the second switch element $Q_2$ can be adjusted by the control of the clamping circuit 110.

The clamping circuit 110 includes a first NPN bipolar junction transistor $B_1$ and a PNP bipolar junction transistor $B_2$. The base of the first NPN bipolar junction transistor $B_1$ is connected to the input end of the clamping circuit 110 for receiving the control signal $Y_{DIM}$. A third resistor $R_3$ is connected between the base of the first NPN bipolar junction transistor $B_1$ and the emitter of the first NPN bipolar junction transistor $B_1$. The base of the first NPN bipolar junction transistor $B_1$ is connected to the ground terminal G through the third resistor $R_3$. The emitter of the first NPN bipolar junction transistor $B_1$ is connected to the ground terminal G. The collector of the first NPN bipolar junction transistor $B_1$ is connected to the base of the PNP bipolar junction transistor $B_2$. The emitter of the PNP bipolar junction transistor $B_2$ is connected to the third inductive winding $T_{1-4}$ through a first diode $D_1$. The anode of the first diode $D_1$ is connected to the third inductive winding $T_{1-4}$. The cathode of the first diode $D_1$ is connected to the emitter of the PNP bipolar junction transistor $B_2$. A fourth resistor $R_4$ is connected between the emitter of the PNP bipolar junction transistor $B_2$ and the base of the PNP bipolar junction transistor $B_2$.

As shown in FIG. 4, the clamping circuit 110 may include a first capacitor $C_1$, a second diode $D_2$, a second capacitor $C_2$, and a voltage divider 1100. The first capacitor $C_1$ is connected between the base of the PNP bipolar junction transistor $B_2$ and the emitter of the PNP bipolar junction transistor $B_2$ for the purpose of filtration. The second capacitor $C_2$ is connected between the base of the first NPN bipolar junction transistor $B_1$ and the emitter of the first NPN bipolar junction transistor $B_1$ for the purpose of filtration. The second diode $D_2$ is connected in parallel with the second capacitor $C_2$ for preventing the second capacitor $C_2$ from being charged to generate a large negative voltage as the voltage on the third inductive winding $T_{1-4}$ is commuting. The voltage divider 1100 is connected to the input end of the clamping circuit 110, the third inductive winding $T_{1-4}$, and the base of the first NPN bipolar junction transistor $B_1$. The voltage divider 1100 may include a fifth resistor $R_5$ and a sixth resistor $R_6$ connected in series with each other. The base of the first NPN bipolar junction transistor $B_1$ is connected between the fifth resistor $R_5$ and the sixth resistor $R_6$. The voltage received by the input end of the clamping circuit 110, i.e. the control signal $V_{DIM}$ and the signal of the inductive winding $T_{1-4}$, passes the voltage divider 1100 in order to provide a fractional voltage for the base of the first NPN bipolar junction transistor $B_1$. When the first NPN bipolar junction transistor $B_1$ is turned on, the base of the PNP bipolar junction transistor $B_2$ is connected to the ground terminal G through the first NPN bipolar junction transistor $B_1$. Therefore, the PNP bipolar junction transistor $B_2$ is also turned on. In this manner, the voltage waveform of the third inductive winding $T_{1-4}$ will be pulled to a low state and commute beforehand, thereby shortening its period and elevating its frequency. As the first inductive winding $T_{1-2}$ and the second inductive winding $T_{1-3}$ are mutually coupled with the third inductive winding $T_{1-4}$, the voltage waveforms of the first inductive winding $T_{1-2}$ and the second inductive winding $T_{1-3}$ will commute beforehand, thereby shortening the period of the voltages on the first inductive winding $T_{1-2}$ and the second inductive winding $T_{1-3}$ and elevating the frequency of the voltages on the first inductive winding $T_{1-2}$ and the second inductive winding $T_{1-3}$. In this manner, the first inductive winding $T_{1-2}$ and the second inductive winding $T_{1-3}$ will drive the switching frequency of the first switch element $Q_1$ and the switching frequency of the second switch element $Q_2$ to increase, thereby regulating the magnitude of the AC output voltage $V_{out}$ to perform the dimming function, break down the light-emitting device, and preheat the filaments of the light-emitting device.

Figure 5:
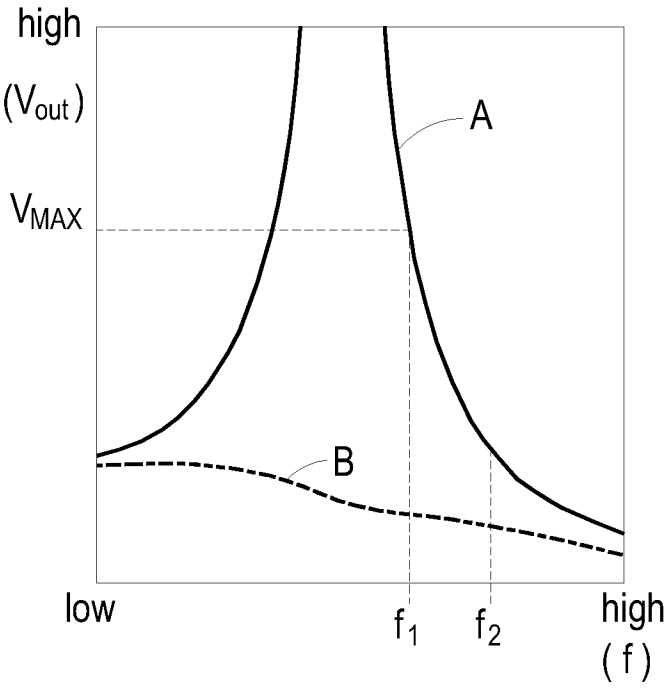
FIG. 5 is a gain curve diagram depicting the gain curve of the AC output voltage versus the switching frequency of the switch element in the square wave generator before the light-emitting device is broken down and the gain curve of the AC output voltage versus the switching frequency of the switch element in the square wave generator after the light-emitting device is broken down.

Referring to FIGS. 3, 4 and 5, in which FIG. 5 is a gain curve diagram depicting the gain curve of the AC output voltage versus the switching frequency of the switch element in the square wave generator before the light-emitting device is broken down and the gain curve of the AC output voltage versus the switching frequency of the switch element in the square wave generator after the light-emitting device is broken down. As shown in FIG. 5, when the light-emitting device 9 has not been broken down, the gain curve of the AC output voltage $V_{out}$ versus the switching frequency f of the switch element in the square wave generator 10, such as the first switch element $Q_1$, is labeled as curve A. Referring to curve A, when the electronic ballast 1 is powered on, the magnitude of the control signal $V_{DIM}$ is relatively large. Thus, the operating frequency of the square wave generator 10 is relatively high (as indicated by the frequency f2). The AC output voltage $V_{out}$ is too low to break down the light-emitting device 9. Hence, the filaments of the light-emitting device 9 can be preheated. After a period of time, the magnitude of the control signal $V_{DIM}$ is going to decline. When the switching frequency of the first switch element $Q_1$ reaches a predetermined frequency f1, the AC output voltage $V_{out}$ reaches a breakdown voltage $V_{MAX}$. Under this condition, the light-emitting device 9 is broken down and starts to ignite. Under this condition, the gain curve of the AC output voltage $V_{out}$ versus the switching frequency f of the first switch element $Q_1$ in the square wave generator 10 is labeled as curve B. It can be known from curve B that the operating frequency of the square wave generator 10 can be further adjusted by changing the magnitude of the control signal $V_{DIM}$, so as to adjust the luminance of the light-emitting device 9. For example, when the magnitude of the control signal $V_{DIM}$ is increasing, the voltage waveform of the third inductive winding $T_{1-4}$ can be commuted earlier. Thus, the switching frequency of the first switch element $Q_1$ and the switching frequency of the second switch element $Q_2$ are increased as well, and the AC output voltage $V_{out}$ is reduced accordingly. Hence, the luminance of the light-emitting device 9 is dimmed.

Figure 6:
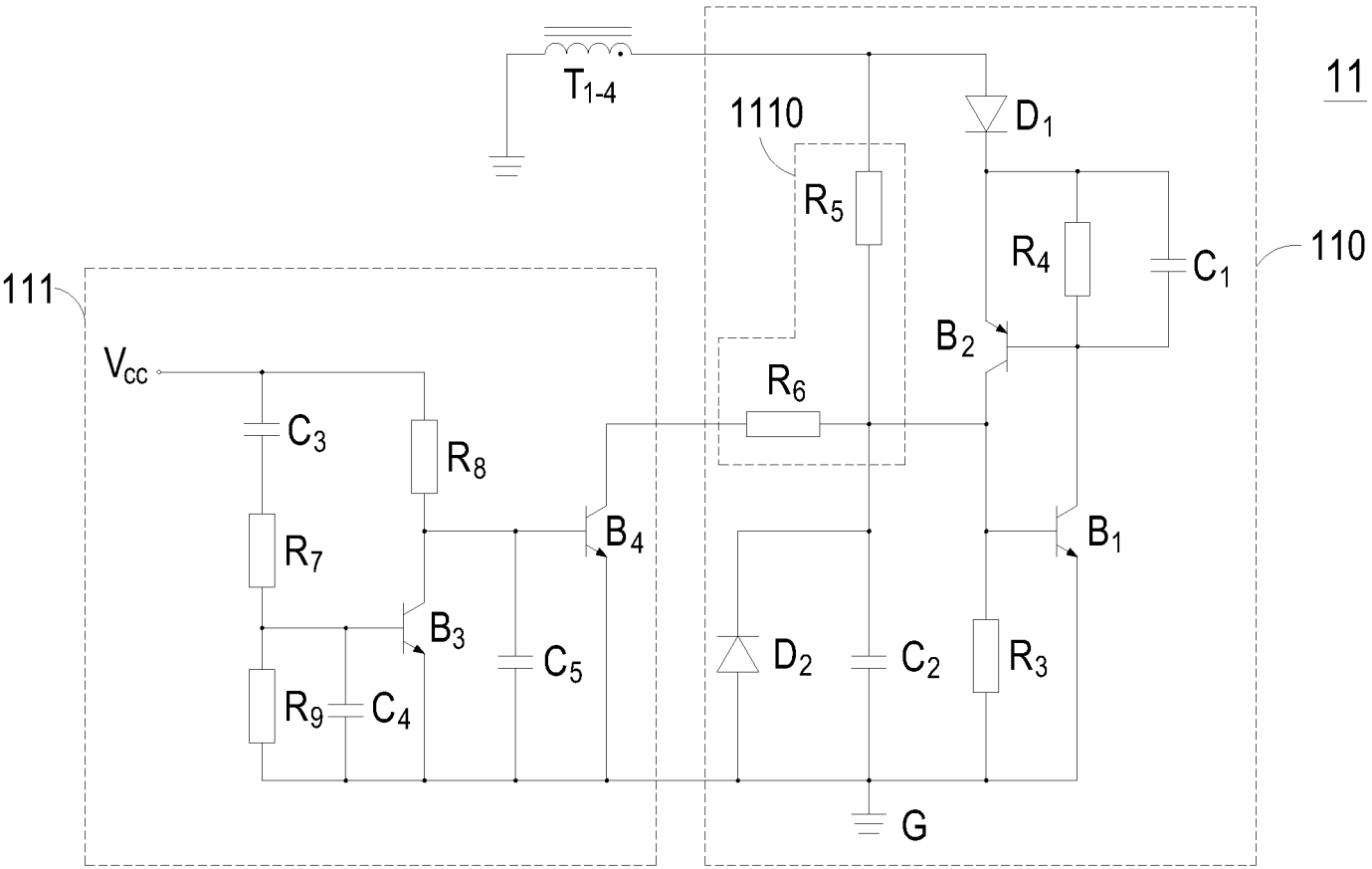
FIG. 6 shows an alternative example of the auxiliary control unit shown in FIG. 4.

Referring to FIGS. 5 and 6, in which FIG. 6 shows an alternative example of the auxiliary control unit shown in FIG. 4. As shown in FIG. 6, the auxiliary control unit 11 employs the clamping circuit 110 and the delay circuit 111 to preheat the filaments of the light-emitting device 9 and break down the light-emitting device 9, thereby prolonging the lifetime of the light-emitting device 9.

The delay circuit 111 is connected to the input end of the clamping circuit 110 for receiving a control signal such as an auxiliary signal $V_{CC}$ when the electronic ballast 1 is started and the light-emitting device 9 has not been broken down to ignite. The auxiliary signal $V_{CC}$ is generated when the electronic ballast 1 is started for providing the power required by the internal elements of the auxiliary control unit 11. The delay circuit 111 is used to drive the clamping circuit according to the auxiliary signal $V_{CC}$ to start operating to drive the voltage waveform of the winding connected to the control unit, such as the third inductive winding $T_{1-4}$, thereby allowing to the voltage waveform of the winding connected to the control unit to commute beforehand within a predetermined time period. Thus, the voltage waveform of the first inductive winding $T_{1-2}$ and the voltage waveform of the second inductive winding $T_{1-3}$ can commute beforehand within the predetermined time period as a result of the mutual coupling with the third inductive winding $T_{1-4}$. Accordingly, the switching frequency of the first switch element $Q_1$ and the switching frequency of the second switch element $Q_2$ are increased, thereby outputting an AC output voltage $V_{out}$ having a voltage level lower than the breakdown voltage $V_{MAX}$ to preheat the light-emitting device 9. It can be known from the curve A of FIG. 5 that the light-emitting device 9 can not be broken down to ignite when the electronic ballast 1 is just started and the voltage level of the AC output voltage $V_{out}$ has not reached the breakdown voltage $V_{MAX}$. If the switch elements are regulated, for example, if the switching frequency of the first switch element $Q_1$ and the switching frequency of the second switch element $Q_2$ are increased, the electronic ballast 1 can output an AC output voltage $V_{out}$ having a low voltage to preheat the light-emitting device 9, thereby prolonging the lifetime of the light-emitting device 9.

In this embodiment, the delay circuit 111 includes a third capacitor $C_3$, a second NPN bipolar junction transistor $B_3$, and a third NPN bipolar junction transistor $B_4$, in which the third capacitor $C_3$ is used to receive the auxiliary signal $V_{CC}$ and is connected to a seventh resistor $R_7$. The third capacitor $C_3$ is connected to the base of the second NPN bipolar junction transistor $B_3$ through the seventh resistor $R_7$. The collector of the second NPN bipolar junction transistor $B_3$ is connected to the base of the third NPN bipolar junction transistor $B_4$ and an eighth resistor $R_8$. The emitter of the second NPN bipolar junction transistor $B_3$ is connected to the ground terminal G. the base of the third NPN bipolar junction transistor $B_4$ is connected to the eighth resistor $R_8$ and is used to receive the auxiliary signal $V_{CC}$ through the eighth resistor $R_8$. The emitter of the third NPN bipolar junction transistor $B_4$ is connected to the ground terminal G. the collector of the third NPN bipolar junction transistor $B_4$ is connected to the input end of the clamping circuit 110.

When the electronic ballast 1 starts operating and the auxiliary signal $V_{CC}$ is generated accordingly, the third capacitor $C_3$ is charged by the auxiliary signal $V_{CC}$. The auxiliary signal $V_{CC}$ is coupled to the base of the second NPN bipolar junction transistor $B_3$ through the third capacitor $C_3$, thereby turning on the second NPN bipolar junction transistor $B_3$. Under this condition, the base of the third NPN bipolar junction transistor $B_4$ is connected to the ground terminal G through the second NPN bipolar junction transistor $B_3$. Thus, the third NPN bipolar junction transistor $B_4$ is turned off. In the meantime, the base of the first NPN bipolar junction transistor $B_1$ is controlled by the voltage on the third inductive winding $T_{1-4}$. When the first NPN bipolar junction transistor $B_1$ is turned on, the base of the PNP bipolar junction transistor $B_2$ is connected to the ground terminal G through the first NPN bipolar junction transistor $B_1$. Thus, the PNP bipolar junction transistor $B_2$ is also turned on. In this manner, the voltage on the third inductive winding $T_{1-4}$ will be pulled to a low level by the ground terminal G and commute beforehand, thereby shortening its period and elevating its frequency. As the first inductive winding $T_{1-2}$ and the second inductive winding $T_{1-3}$ are mutually coupled with the third inductive winding $T_{1-4}$, the voltage on the first inductive winding $T_{1-2}$ and the voltage on the second inductive winding $T_{1-3}$ will also commute beforehand so as to shorten their periods and elevate their frequency. Therefore, the switching frequency of the first switch element $Q_1$ and the switching frequency of the second switch element $Q_2$ will increase. Under this condition, the electronic ballast 1 will output an AC output voltage $V_{out}$ having a small voltage level, thereby preventing the light-emitting device from being broken down and preheating the filaments of the light-emitting device 9.

When the third capacitor $C_3$ is fully charged by the auxiliary signal $V_{CC}$ as the predetermined time period is elapsed, the auxiliary signal $V_{CC}$ can not be coupled to the base of the second NPN bipolar junction transistor $B_3$. Under this condition, the second NPN bipolar junction transistor $B_3$ will turn off. In the meantime, the base of the third NPN bipolar junction transistor $B_4$ will receive the auxiliary signal $V_{CC}$ through the eighth resistor $R_8$, thereby turning on the third NPN bipolar junction transistor $B_4$. Under this condition, the base of the first NPN bipolar junction transistor $B_1$ is grounded through the input end of clamping circuit 110 and the third NPN bipolar junction transistor $B_4$. Thus, the first NPN bipolar junction transistor $B_1$ is turned off and the PNP bipolar junction transistor $B_2$ is also turned off. Therefore, the voltage on the third inductive winding $T_{1-4}$ will be stopped from being pulled to a low level by the ground terminal G. Hence, the switching frequency of the first switch element $Q_1$ and the switching frequency of the second switch element $Q_2$ will return to the normal value and the light-emitting device 9 will be broken down by the resonance of the resonant circuit 12.

In this embodiment, the delay circuit 111 will drive the clamping circuit 110 to start operating or stop operating according to the auxiliary signal $V_{CC}$, thereby preheating the filament and breaking down the light-emitting device. The capacitance of the third capacitor $C_3$ and the resistance of the seventh resistor $R_7$ and the resistance of the ninth resistor $R_9$ will determine the duration of the time for preheating.

In this embodiment, the delay circuit may further include a fourth capacitor $C_4$, a fifth capacitor $C_5$, and a ninth resistor $R_9$, in which the fourth capacitor $C_4$ is connected between the base of the second NPN bipolar junction transistor $B_3$ and the emitter of the second NPN bipolar junction transistor $B_3$ for the purpose of filtration. The ninth resistor $R_9$ is connected in parallel with the fourth capacitor $C_4$ between the base of the second NPN bipolar junction transistor $B_3$ and the emitter of the second NPN bipolar junction transistor $B_3$. The fifth capacitor $C_5$ is connected between the base of the third NPN bipolar junction transistor $B_4$ and the emitter of the third NPN bipolar junction transistor $B_4$ for the purpose of filtration.

In conclusion, the inventive electronic ballast is configured to mutually couple the driving winding and the inductive windings of a transformer together and connect a portion of the inductive windings to the control terminal of the switch elements in the square wave generator, in order to control the switching operations of the switch elements. Hence, the voltage waveforms of the inductive windings connected to the control terminals of the switch elements can be controlled by adjusting the voltage waveform of the driving winding or by adjusting the voltage waveform of any one of the inductive windings. In this manner, the switching frequency of the switch elements can be adjusted for providing different AC output voltage for the light-emitting device. Therefore, the filaments of the light-emitting device can be preheated, the light-emitting device can be broken down, and the luminance of the light-emitting device can be dimmed under the self-oscillating topology.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. An electronic ballast for driving at least one light-emitting device, comprising:

a square wave generator receiving a DC input voltage and having a plurality of switch elements for converting the DC input voltage into a square-wave AC voltage according to switching operations of the plurality of switch elements;

a transformer having a driving winding and first and second inductive windings mutually connected with each other, wherein the first and second inductive windings are respectively connected to a control terminal of the corresponding one of the plurality of switch elements, the transformer further including a third inductive winding that is magnetically coupled to the first and second inductive windings and to the drive winding;

a resonant circuit connected to the driving winding and the at least one light-emitting device for receiving the square-wave voltage through the driving winding and converting the square-wave voltage into an AC output voltage to drive the at least one light-emitting device; and an auxiliary control unit connected to the third inductive winding of the transformer to directly control a voltage waveform of the third inductive winding which, due to the magnetic coupling, indirectly controls a voltage waveform of the first and second inductive windings according to at least one control signal, thereby changing the voltage waveform of the first and second inductive windings for adjusting switching frequencies of the plurality of switch elements.

2. The electronic ballast according to claim 1 wherein the electronic ballast is a self-oscillating electronic ballast.

3. The electronic ballast according to claim 1 wherein the at least one light-emitting device is a fluorescent lamp.

4. The electronic ballast according to claim 1 wherein the resonant circuit is connected in parallel with the at least one light-emitting device and includes a resonant inductor and a resonant capacitor, and wherein the resonant capacitor is connected in parallel with the at least one light-emitting device and is connected to the resonant inductor to form a parallel resonant circuit.

5. The electronic ballast according to claim 1 wherein the driving winding and the first and second inductive windings are magnetically coupled with each other.

6. The electronic ballast according to claim 1 wherein the square wave generator includes a first switch element and a second switch element, the first inductive winding and the second inductive winding having opposite polarities, and wherein the first inductive winding is connected to a control terminal of the first switch element through a first resistor and the second inductive winding is connected to a control terminal of the second switch element through a second resistor.

7. The electronic ballast according to claim 1 wherein the auxiliary control unit includes a clamping circuit connected to the third inductive winding for receiving the at least one control signal.

8. The electronic ballast according to claim 7 wherein the luminance of the at least one light-emitting device is dimmed with the increase of the voltage level of the at least one control signal.

9. The electronic ballast according to claim 7 wherein the clamping circuit includes:

a first NPN bipolar junction transistor having a base for receiving the at least one control signal, an emitter connected to a ground terminal, and a collector;

a PNP bipolar junction transistor having a base connected to the collector of the first NPN bipolar junction transistor, an emitter connected to the third inductive winding connected to the clamping circuit, and a collector connected to the ground terminal.

10. The electronic ballast according to claim 9 wherein the clamping circuit further includes:

a first diode having an anode connected to the third inductive winding connected to the clamping circuit and a cathode connected to the emitter of the PNP bipolar junction transistor;

a first capacitor;

a third resistor connected between the base of the first NPN bipolar junction transistor and the emitter of the first NPN bipolar junction transistor;

a fourth resistor connected in parallel with the first capacitor between the base of the PNP bipolar junction transistor and the emitter of the PNP bipolar junction transistor; and a voltage divider connected to the base of the first NPN bipolar junction transistor, and including a fifth resistor and a sixth resistor connected in series with each other.

11. The electronic ballast according to claim 9 wherein the clamping circuit further includes:

a second capacitor connected between the base of the first NPN bipolar junction transistor and the emitter of the first NPN bipolar junction transistor; and a second diode connected in parallel with the second capacitor for preventing the second capacitor from generating a large negative voltage during charging.

12. The electronic ballast according to claim 9 wherein the clamping circuit further includes a delay circuit connected to the clamping circuit for receiving an auxiliary signal generated when the electronic ballast is started and driving the clamping circuit according to the auxiliary signal, thereby driving the clamping circuit to regulate a voltage waveform of the third inductive winding.

13. The electronic ballast according to claim 12 wherein the delay circuit includes:

a third capacitor for receiving the auxiliary signal;

a second NPN bipolar junction transistor having a base, an emitter connected to the ground terminal, and a collector;

a seventh resistor connected between the third capacitor and the base of the second NPN bipolar junction transistor; and a third NPN bipolar junction transistor having a base connected to the collector of the second NPN bipolar junction transistor for receiving the auxiliary signal, an emitter connected to the ground terminal, and a collector connected to the base of the first NPN bipolar junction transistor.

14. The electronic ballast according to claim 12 wherein the delay circuit further includes:

a fourth capacitor;

a fifth capacitor connected between the base of the third NPN bipolar junction transistor and the emitter of the third NPN bipolar junction transistor;

an eighth resistor for receiving the auxiliary signal and connected to the base of the third NPN bipolar junction transistor; and a ninth resistor connected in parallel with the fourth capacitor between the base of the second NPN bipolar junction transistor and the emitter of the second NPN bipolar junction transistor.

15. The electronic ballast according to claim 14 wherein a capacitance of the third capacitor, the resistance of the seventh resistor, and the resistance of the ninth resistor determines the duration of the time for preheating filaments of the at least one light-emitting device.

* * * * *